US010080398B2

(12) United States Patent
Maccioni et al.

(10) Patent No.: US 10,080,398 B2
(45) Date of Patent: Sep. 25, 2018

(54) METHOD FOR PRODUCING A FOOTWEAR ITEM HAVING A SHOE PROVIDED WITH AN EXTERNAL UPPER

(71) Applicant: DECATHLON, Villeneuve d'Ascq (FR)

(72) Inventors: Luca Maccioni, Saccolongo (IT); Adrien Lagneau, Sars et Rosieres (FR)

(73) Assignee: DECATHLON, Villeneuve d'Ascq (FR)

( * ) Notice: Subject to any disclaimer, the term of this patent is extended or adjusted under 35 U.S.C. 154(b) by 250 days.

(21) Appl. No.: 15/103,732

(22) PCT Filed: Nov. 25, 2014

(86) PCT No.: PCT/FR2014/053031

§ 371 (c)(1),
(2) Date: Jun. 10, 2016

(87) PCT Pub. No.: WO2015/086942

PCT Pub. Date: Jun. 18, 2015

(65) Prior Publication Data

US 2016/0309835 A1 Oct. 27, 2016

(30) Foreign Application Priority Data

Dec. 11, 2013 (FR) ..... 13 62436

(51) Int. Cl.
*A43B 23/02* (2006.01)
*A43B 7/12* (2006.01)
(Continued)

(52) U.S. Cl.
CPC ..... *A43B 7/12* (2013.01); *A43B 3/02* (2013.01); *A43B 5/0427* (2013.01); *A43B 7/084* (2013.01);
(Continued)

(58) Field of Classification Search
CPC .. A43B 7/12; A43B 7/084; A43B 3/02; A43B 3/04; A43B 3/08; A43B 9/02;
(Continued)

(56) References Cited

U.S. PATENT DOCUMENTS 1,061,740 A * 5/1913 Gehant ..... A43B 3/02 36/1.5
1,712,035 A * 5/1929 Frykman ..... A43B 3/02 36/1.5
(Continued)

FOREIGN PATENT DOCUMENTS

FR 527504 A 10/1921
WO WO-03/034857 A1 5/2003
WO WO-2007/007369 A1 1/2007

OTHER PUBLICATIONS

STIC, Non-Patent Literature: Abstracts and Full Text Databases, Apr. 19, 2018*
(Continued)

*Primary Examiner* — Jameson Collier
*Assistant Examiner* — Heather Mangine
(74) *Attorney, Agent, or Firm* — Marshall, Gerstein & Borun LLP

(57) ABSTRACT

A method for producing a footwear item having a shoe provided with an external upper. The invention concerns a method for producing a footwear item having a shoe (1) provided with an external upper (9), the method involving forming a shoe (1) with an intermediate portion (2) that delimits a housing (3) for receiving the foot of a user, a sleeve (5) mounted over the intermediate portion and a peripheral skirt (10) extending from the junction area between the intermediate portion and the sleeve, surrounding the base (8) of the sleeve, the method involving the following successive steps in order to provide the shoe with the upper: retracting the sleeve (5) into the receiving housing
(Continued)

(3) until the sleeve is disposed under at least a portion of the skirt (10); associating a lower portion (9*a*) of the upper (9) with the skirt; deploying the sleeve over the intermediate portion (2) in order for it to extend into the upper.

8 Claims, 3 Drawing Sheets

(51) Int. Cl.

| | |
|---|---|
| ***A43B 3/02*** | (2006.01) |
| ***A43B 9/02*** | (2006.01) |
| ***A43D 8/00*** | (2006.01) |
| ***A43B 5/04*** | (2006.01) |
| ***A43B 7/08*** | (2006.01) |
| ***A43B 13/22*** | (2006.01) |
| ***A43B 17/00*** | (2006.01) |
| ***A43B 23/07*** | (2006.01) |

(52) U.S. Cl.
CPC ..... *A43B 9/02* (2013.01); *A43B 13/223* (2013.01); *A43B 17/00* (2013.01); *A43B 23/0215* (2013.01); *A43B 23/07* (2013.01)

(58) Field of Classification Search
CPC . A43B 23/0215; A43B 23/07; A43B 13/0245; A43B 23/025; A43B 23/027; A43B 2/042; A43B 23/063
USPC ..... 36/109, 55; 12/146 C, 55, 57
See application file for complete search history.

(56) References Cited

U.S. PATENT DOCUMENTS 1,851,629 A * 3/1932 Herzstein ..... A43B 3/02 36/45
2,200,333 A * 5/1940 Herzog ..... A43B 1/10 12/142 E
2,306,306 A * 12/1942 Ferrettie ..... A43B 3/02 36/4
2,703,937 A * 3/1955 McGinn ..... A43B 3/02 36/3 R
2,728,999 A * 1/1956 Hollier ..... A43B 3/02 36/28
3,435,544 A * 4/1969 Henry ..... A43B 3/02 2/62
3,618,232 A * 11/1971 Shnuriwsky ..... A43B 3/02 36/1.5
3,744,158 A * 7/1973 Walker ..... A43B 3/02 36/1.5
3,981,088 A * 9/1976 Mitchell ..... A43B 3/101 36/87
3,991,492 A * 11/1976 Dreyer ..... A43B 3/02 36/109
4,244,121 A * 1/1981 Adams ..... A43B 23/06 12/142 F
4,538,368 A * 9/1985 Mugford ..... A43B 3/16 36/112
4,693,018 A * 9/1987 Maleyko ..... A43B 3/02 36/1.5
4,748,749 A * 6/1988 Colvard ..... A41D 17/00 36/10
5,249,375 A * 10/1993 Tabarly ..... A43B 7/12 36/1.5
5,642,573 A * 7/1997 Brown ..... A41D 17/00 36/132
5,937,543 A * 8/1999 Hall ..... A43B 7/32 36/10
6,115,940 A * 9/2000 Chen ..... A43B 7/12 12/142 E
6,148,544 A * 11/2000 Keen ..... A43B 5/06 36/1.5
6,665,954 B2 * 12/2003 Chen ..... A43B 3/02 36/3 A
7,051,459 B1 * 5/2006 Wigutow ..... A43B 23/06 36/10
7,370,438 B2 * 5/2008 Vattes ..... A43B 7/1465 36/10
7,908,767 B1 * 3/2011 Mordecai ..... A43B 3/02 36/1.5
8,056,149 B2 * 11/2011 Duclos ..... A43B 19/00 2/239
8,677,539 B2 * 3/2014 Morlacchi ..... A43B 7/125 12/146 BR
9,510,641 B1 * 12/2016 Skinner ..... A43B 7/12
2001/0037587 A1 * 11/2001 Lu ..... A43B 7/12 36/14
2002/0120977 A1 * 9/2002 Smith ..... A41B 11/00 2/242
2004/0080077 A1 * 4/2004 Gumringer ..... A43B 3/0084 264/244
2004/0143996 A1 * 7/2004 Chen ..... A43B 7/125 36/55
2004/0187352 A1 * 9/2004 Chen ..... A43B 7/12 36/55
2005/0028251 A1 * 2/2005 Walsh ..... A41B 11/00 2/242
2006/0117598 A1 * 6/2006 Czaplewski ..... A41D 17/00 36/2 R
2006/0185192 A1 * 8/2006 Biancucci ..... A43B 3/06 36/45
2007/0062067 A1 * 3/2007 Covatch ..... A43B 3/24 36/55
2010/0275465 A1 * 11/2010 Reilly ..... A43B 1/0045 36/136
2011/0047675 A1 * 3/2011 Aldridge ..... A41F 17/00 2/227
2011/0239487 A1 * 10/2011 Renkes ..... A43B 3/02 36/136
2011/0307993 A1 * 12/2011 McAfee ..... A41D 13/012 2/82
2012/0047766 A1 * 3/2012 Moore ..... A43B 3/242 36/1.5
2013/0036626 A1 * 2/2013 Briant ..... A43B 3/242 36/58.5
2013/0133229 A1 * 5/2013 Ludemann ..... A43B 3/02 36/109
2014/0075784 A1 * 3/2014 Webb ..... A43B 3/02 36/109
2014/0115927 A1 * 5/2014 Lucas ..... A43B 23/24 36/109
2014/0215851 A1 * 8/2014 Solsona ..... A43B 9/02 36/84
2015/0173453 A1 * 6/2015 Liu ..... A43B 7/12 36/4

OTHER PUBLICATIONS

International Search Report for International Application No. PCT/FR2014/053031, dated Mar. 20, 2015.

* cited by examiner

METHOD FOR PRODUCING A FOOTWEAR ITEM HAVING A SHOE PROVIDED WITH AN EXTERNAL UPPER

CROSS-REFERENCE TO RELATED APPLICATION

The present application is the US national phase of International Patent Application No. PCT/FR2014/053031, filed Nov. 25, 2014, which application claims priority to French Application No. FR 1362436, filed Dec. 11, 2013. The priority application, FR 1362436, is hereby incorporated by reference.

FIELD OF THE DISCLOSURE

This invention relates to a method of making footwear including a boot fitted with an outer upper. The invention also relates to footwear made by implementing such a method.

BACKGROUND

In order to be able to walk in wet and/or snowy conditions, footwear exists composed of a single-piece boot made of a thermoplastic material that is sufficiently impermeable to prevent the penetration of water through the boot.

These boots have an intermediate part delimiting a housing for holding the foot, or even the ankle depending on its dimensions, the intermediate part being fitted with an outer sole that improves bond and/or grip on the ground. An inner sole and/or a sock can also be placed inside the boot to improve thermal insulation and comfort.

To limit the risk of ingress of water and/or snow into the footwear, such boots may be fitted with a top sleeve which surmounts in a single piece the intermediate part, the boot then being in the form of a tall boot, the sleeve of which is arranged to extend over at least a part of the user's leg.

To improve the aesthetics of the footwear, the boot can be fitted with an outer upper that extends around the sleeve, particularly in order to conceal it, the outer upper being provided with patterns, textures and/or colors satisfying the user's wishes.

The outer upper may also be adapted to optimize some properties of the footwear, such as impermeability and/or thermal insulation properties, for example by being made from a flexible water repellent and/or insulating textile material.

However, one of the difficulties in making such footwear is to connect the outer upper to the boot without degrading the impermeability and/or thermal insulation provided by the boot to the footwear.

To achieve this, methods are known for making footwear in which the outer upper is attached to the boot at the same time that the boot is formed, for example by vulcanization or molding. Such methods allow to attach the outer upper without changing manufacturing of the boot but they are not fully satisfactory in that they require that the outer upper should be put into position when the boot is formed, which is complex to implement reliably.

To overcome this problem, document WO-2007/007369 discloses that the outer upper can be fixed onto the boot after formation of the boot. Indeed, this document discloses that the lower part of the outer upper can be stitched onto a lip formed on the upper edge of the intermediate part.

However, such an embodiment requires additional operations to maintain the impermeability of the footwear because the holes formed in the lip by the stitches lead to the possibility of water, air and/or moisture penetration inside the boot. To do so, an impermeable coating is glued to the inside of the boot while extending at least over the stitches.

Therefore this appended waterproofing solution increases the complexity of the method of manufacturing the footwear, requiring additional labor and tools associated with high costs. Moreover, the efficiency of such an inner coating is not always guaranteed in the long term, since the coating can deteriorate during use, particularly by friction with the user's foot.

SUMMARY OF THE DISCLOSURE

The invention aims at improving prior art particularly by disclosing a method of making footwear with a boot fitted with an outer upper that is easy to implement while maintaining the impermeability of the footwear at the junction between the boot and the outer upper.

To achieve this, according to a first aspect, the invention discloses a method of making footwear with a boot fitted with an outer upper, the method including forming a boot including an intermediate part that delimits a housing for holding a user's foot, a top sleeve surmounting the intermediate part and a peripheral lip extending from the junction zone between the intermediate part and the sleeve and surrounding the base of the sleeve, the method including the following successive steps to fit the outer upper on the boot:

- retracting the sleeve into the holding housing until the sleeve is located under at least a part of the lip;
- attaching a lower part of the outer upper on the lip;
- extending the sleeve above the intermediate part so that it extends inside the outer upper.

According to a second aspect, the invention discloses footwear made by implementing such a method, to include a boot that comprises an intermediate part surmounted by a sleeve, the base of which is surrounded by a peripheral lip, the boot being fitted with an outer upper, a lower part of which is attached to the lip, the lower part being separate from the base of the sleeve.

Other special features and advantages of the invention will become clear after reading the following description made with reference to the appended figures, in which:

DETAILED DESCRIPTION OF THE PREFERRED EMBODIMENTS

Figure 1:
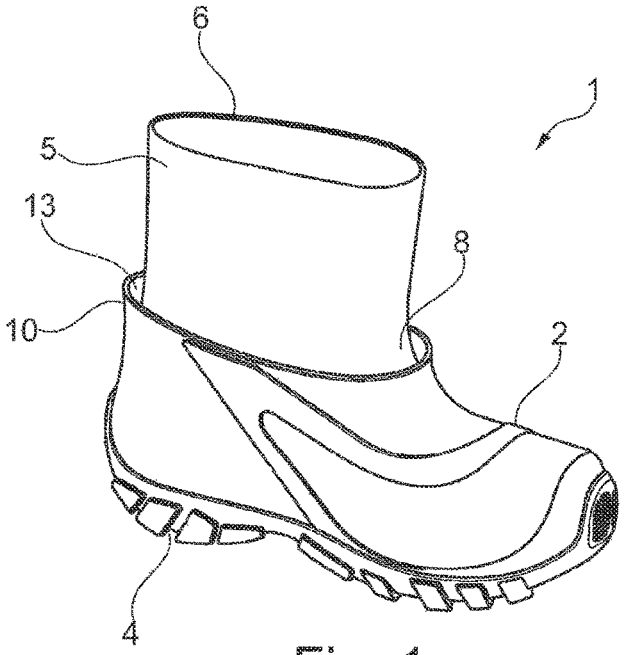
FIG. 1 is a perspective view of the boot of footwear according to one embodiment.

With reference to these figures, the following describes a method of making footwear that is suitable for use particularly when walking under wet and/or snowy conditions, for example after winter sports such as skiing.

The footwear includes; a boot 1 in the form of a protective shell that materializes the frame of the footwear by being adapted to protect at least the foot of a user. In particular, the boot includes an intermediate part 2 that delimits a housing 3 for holding the foot, even a part of the user's ankle depending on the dimensions of the intermediate part.

According to the embodiments shown, the intermediate part 2 has dimensions selected to surround the user's toes, the ball of the foot and the heel. However, the invention is not limited to a particular geometry of the intermediate part 2, the intermediate part may have smaller or larger dimensions depending on the part of the foot and/or ankle to be covered.

An insole may be placed in the bottom of the holding housing 3 to improve walking comfort and/or properties of the footwear depending on the user's needs and/or outdoor conditions, such as thermal insulation or shock absorption of the footwear.

A wear sole 4 is placed under the intermediate part 2, the wear sole possibly being added under the intermediate part, for example by gluing or welding, or it may be formed in a single part with the intermediate part.

The wear sole 4 is adapted to improve bond and/or grip of the footwear on the ground, for example by having a notched structure that in particular prevents slipping. For example, the wear sole 4 may have 4 mm high notches that improve grip on snowy ground. As a variant or in a complementary manner, the wear sole 4 may have a specific component to improve its slip resistant properties.

In order to reduce the risk of ingress of water and/or snow in the footwear, the boot 1 includes a top sleeve 5 that surmounts the intermediate part 2 to a predetermined height, the free upper edge 6 of the sleeve defining an access opening to the holding housing 3. In the embodiments shown, the boot 1 is thus in the form of a tall boot, of which the sleeve 5 is arranged to extend over at least a part of the user's leg.

It is planned to make the boot 1 from a material that is sufficiently impermeable to prevent the penetration of water through the boot. The material used may be based on polyvinyl chloride (PVC) and/or ethylene vinyl acetate (EVA) which limits the weight of the footwear while providing satisfactory impermeability and resistance to abrasion.

Advantageously, the boot 1 is made in a single piece in a monobloc manner, for example by injection molding of a thermoplastic material particularly to obtain a continuous and impermeable junction zone between the intermediate part 2 and the top sleeve 5. According to one embodiment, the boot 1 may be made from a breathing material, for example based on polyurethane, and/or being micro-perforated.

Furthermore, in order to improve the breathability properties of the footwear, it can be planned to form aeration means in a part of the sleeve 5 that is sufficiently high to prevent risks of ingress of water and/or snow through the aeration means.

Figure 7:
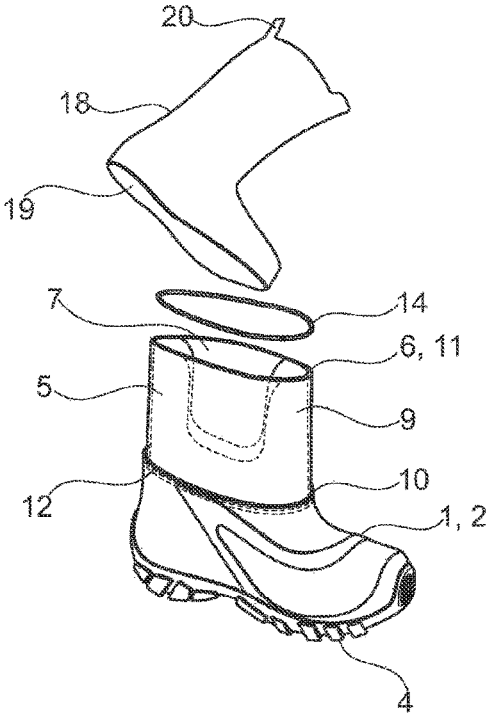
FIG. 7 is a perspective view of footwear according to one embodiment, showing the placement of a sock in the boot.

In one embodiment (FIG. 7), at least one cut is made from the upper edge 6 of the sleeve 5 to form a side aeration opening 7. A material permeable to air may also be placed in the side opening 7 by being attached to the edges of the opening.

In particular, the side opening 7 extends partially into the sleeve 5 such that the impermeability of the sleeve is maintained at least at a base 8 of the sleeve that is connected to the intermediate part 2. As a variant, the sleeve 5 may have a plurality of holes distributed above the base 8 of the sleeve.

To improve the aesthetics of the footwear, it is planned to fit the boot 1 with an outer upper 9 which can have patterns, textures and/or colors satisfying the user's wishes, the outer upper extending from the intermediate part 2 to at least partly cover the sleeve 5 including the base 8 particularly to conceal the part of the sleeve.

The outer upper 9 may be made from a textile material, for example based on polyester, giving it some flexibility, the material possibly being water repellent, thermally insulating and/or impermeable-breathing. As a variant, the outer upper 9 may be made from leather to improve the strength and protection function of the footwear. The outer upper 9 may also include an internal and/or external lining, for example made respectively from foam or strong and impermeable fabric to improve some properties of the footwear, such as its impermeability and/or thermal insulation properties.

The outer upper 9 has a closed geometry that is complementary to the geometry of the sleeve 5, and preferably does not have any stitches to limit the infiltration of water and/or moisture through the outer upper. The outer upper 9 may for example be made flat by a thermoforming or high frequency process depending on the required shape to prevent the need for stitching before being cut to be attached to the boot 1.

To fit the boot with the outer upper 9, it is planned to form a peripheral lip 10 around the base 8 of the sleeve 5 and onto which a lower part 9*a* of the outer upper is attached. The lip 10 may be added onto the boot 1, for example by overmolding, or advantageously, it may be formed during molding of the boot.

With reference to the figures, the lip 10 extends outwards and upwards from the junction zone between the intermediate part 2 and the sleeve 5 so as to surround the base 8 of the sleeve. Thus, a lower part 9*a* of the outer upper 9 may be attached to the lip 10 so that the outer upper covers the base 8 in particular, the intermediate part 2 being exposed.

In particular, the outer upper 9 may be approximately the same height as or taller than the sleeve 5 so as to cover the entire sleeve with an upper edge 11 facing the upper edge of the sleeve and/or extending above the sleeve depending on the required appearance of the footwear.

The lower part 9*a* of the outer upper 9 is advantageously attached to the lip 10 after formation of the boot 1 to facilitate its relative positioning. In particular, the lower part 9*a* may be permanently fixed onto the lip 10, particularly by stitching, welding or gluing. In the embodiments shown, the lower part 9*a* is attached to the lip 10 by double stitching 12 to enable fast attachment while guaranteeing strength.

As a variant, the lower part 9*a* may be removably attached to the lip 10, for example by self-gripping means fixed to the lip and the lower part, so that the outer upper 9 can be replaced by another outer upper with different functional properties, dimensions and/or a different aesthetic appearance, for example in terms of colors and/or patterns.

According to the method of making, it is planned to attach the lower part 9*a* of the outer upper 9 to the inner face of the lip 10 that is facing the base 8 of the sleeve 5 particularly so as to protect the lower part from the outer elements, particularly limiting risks of s the outer upper being torn off. To achieve this, the boot 1 is formed with a peripheral groove 13 that extends between the lip 10 and the base 8 of the sleeve 5, the groove being open upwards and sufficiently wide to hold the lower part 9*a* of the outer upper 9.

Figure 2A:
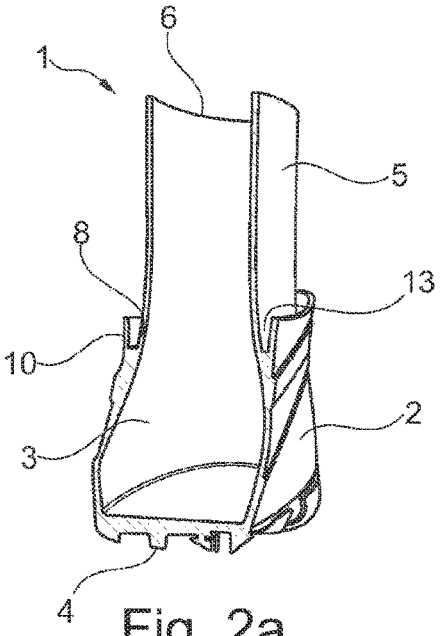
FIG. 2*a* is a longitudinal sectional view of the boot in FIG. 1.
Figure 2B:
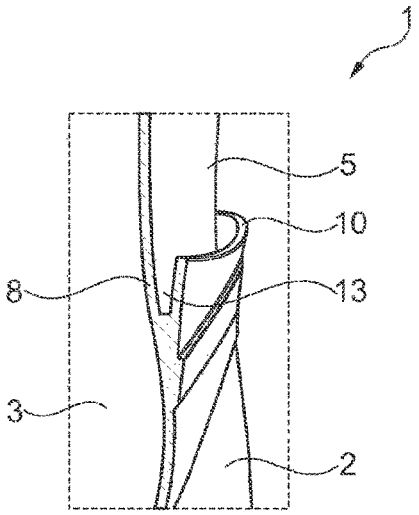
FIG. 2*b* is an enlarged view of the longitudinal sectional view of FIG. 2*a* showing more particularly the peripheral lip of the boot.

With reference to FIG. 2, the groove 13 has a bottom that is formed on a thickness of the junction zone between the intermediate part 2 and the sleeve 5, the thickness being particularly capable of providing sufficient strength at the junction zone to resist applied loads.

To enable adjustment to the position of the outer upper 9 on the sleeve 5, it is planned to place the lower part 9*a* of the outer upper inside the groove 13 before it is fixed to the lip 10, with the lower edge of the outer upper stopping in contact with the bottom of the groove.

In order to keep the inside of the boot 1 impermeable during operations to attach the lower part 9*a* onto the lip 10, and particularly to prevent risks of perforation in case of stitching, the method includes retraction of the sleeve 5 into the holding housing 3 before the attachment, until the sleeve is located under at least a part of the lip.

Such retraction of the sleeve 5 can limit risks of holes that could be formed in the sleeve by stitches 12 at which water, air and/or moisture might be able to penetrate through the sleeve. Impermeability and/or thermal insulation properties of the boot 1 are thus maintained after stitching, without it being necessary to make the stitching zone between the lip 10 and the outer upper 9 and/or the wall of the sleeve 5 waterproof, for example by a liquid coating or an impermeable textile.

In particular, the sleeve 5 is retracted at least until the upper edge 6 of the sleeve is located at least under the upper edge of the lip 10, so that the lower part 9*a* of the outer upper 9 can then be stitched onto the upper edge of the lip 10 from inside or outside of the lip without any risk of deterioration of the sleeve.

Figure 3:
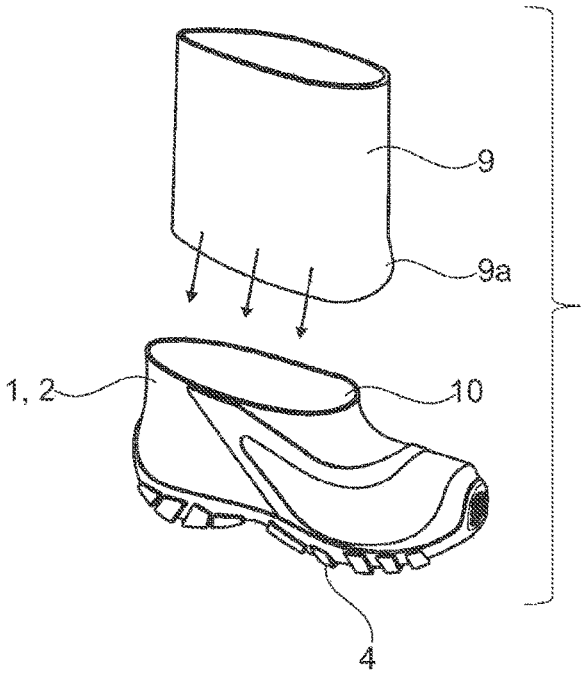
FIG. 3 is a perspective view of the footwear in FIG. 1; showing a step in making the footwear, showing the boot with the sleeve retracted and without the outer upper.
Figure 4:
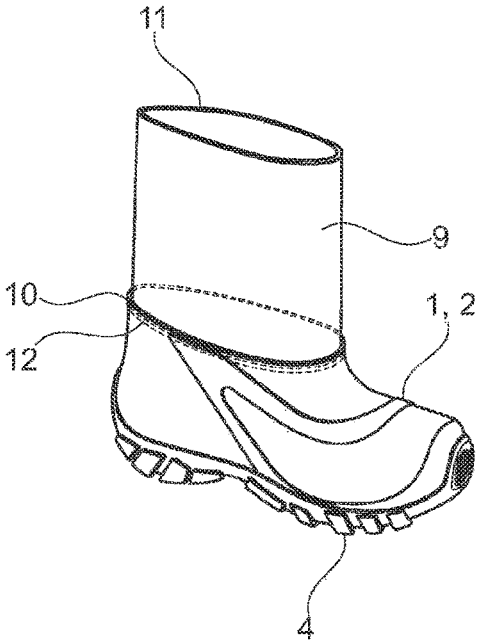
FIG. 4 is a perspective view of the footwear in FIG. 1, similar to FIG. 3, but showing a step in making the footwear in which the boot is shown with the sleeve retracted and with the outer upper.

With reference to FIGS. 3 and 4, the entire sleeve 5 is retracted inside the holding housing 3, the lower part 9*a* being attached to the lip 10 with the sleeve held in the retracted position. The complete retraction of the sleeve 5 releases the inner part of the lip 10 so that stitching operations can be performed on each side of the lip. The lower part 9*a* of the outer upper 9 can thus be stitched quickly and easily on any part of the lip 10, from the inside or outside of the lip, without any risk of damage to the sleeve 5.

In particular, the boot 1 is formed with a sleeve 5 of which the thickness is adapted to facilitate in particular manual retraction of the sleeve in the holding housing 3. The sleeve 5 can thus have a thickness between 1 and 3 mm so that it is sufficiently supple and flexible to be retracted of and pushed into the holding housing 3, particularly by reversible deformation.

Furthermore, the suppleness of the sleeve 5 improves walking comfort and makes it easier to put the footwear on and/or to take it off, particularly without needing to add means of tightening and/or to form a longitudinal slit in the sleeve 5 to increase the diameter of the access opening.

With the embodiments shown, the thickness of the sleeve 5 is less than the thickness of the intermediate part 2 that is designed to be sufficiently stiff to maintain stability and protection of the foot located in the holding housing 3.

Figure 5:
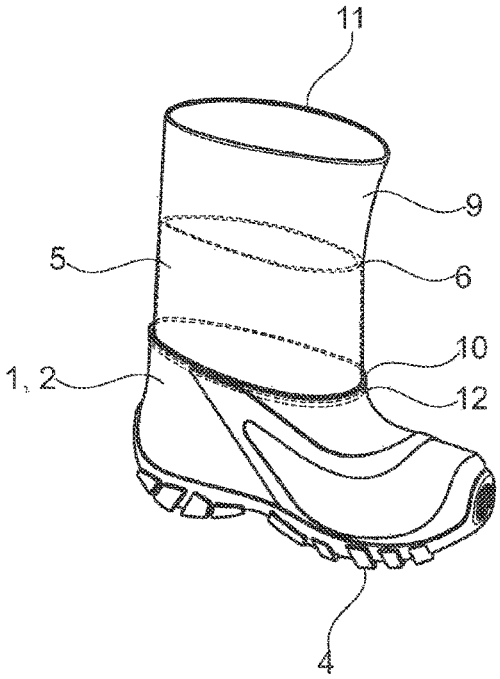
FIG. 5 is a perspective view of the footwear in FIG. 1, showing a step in making the footwear, showing the boot fitted with the outer upper and with the sleeve extended.

After the lower part 9*a* has been attached to the lip 10, it is planned to raise the sleeve 5 particularly manually to extend it above the intermediate part 2 so that the sleeve extends inside the outer upper 9 (FIG. 5). The lower part 9*a* of the outer upper 9 can thus be attached to the lip 10 particularly by being separate from the base 8 of the sleeve 5 that remains perfectly impermeable because it does not have any stitches.

The outer upper 9 may be kept separate from the sleeve 5 after extension, for example for allowing the insertion of a trouser leg can be inserted between the sleeve and the outer upper, the outer upper possibly performing a function similar to that of a gaiter.

As a variant, the outer upper 9 may be fixed onto the sleeve 5 after extension to improve retention of the outer upper around the sleeve, particularly by preventing risks of the outer upper being lowered, for example in the case of an outer upper 9 made from a supple textile material. Furthermore, an edging part 14 may be attached to the upper edge 6, 11 of the sleeve 5 and/or the outer upper 9 in order to improve the appearance of the footwear and/or retention between the outer upper and the sleeve.

Figure 6A:
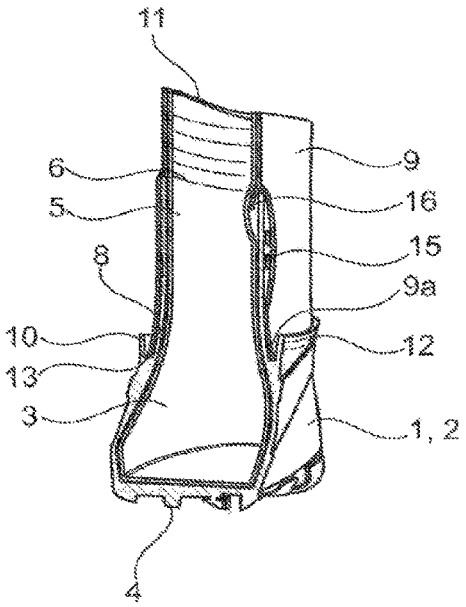
FIG. 6*a* is longitudinal sectional view of footwear according to a variant embodiment in which the outer upper is attached to the sleeve, the outer upper extending above the sleeve.
Figure 6B:
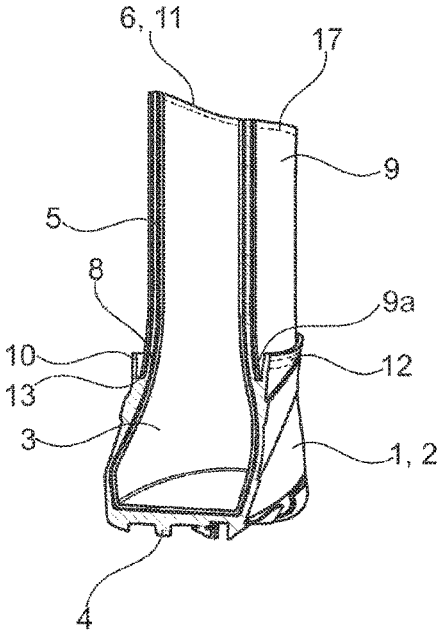
FIG. 6*b* is a longitudinal sectional view of footwear according to a variant embodiment in which the outer upper is attached to the sleeve, the outer upper having an upper edge facing the upper edge of the sleeve.

With reference to FIGS. 6*a* and 6*b*, two embodiments are described in which, after extension of the sleeve 5, the outer upper 9 is attached, depending on its height, by gluing or stitching onto a part of the sleeve located above the base 8.

Particularly in the case in which the height of the outer upper 9 is greater than the height of the sleeve 5, it can be planned to fix the outer upper onto the sleeve by gluing in order to maintain impermeability of the sleeve. With reference to FIG. 6*a*, the footwear is provided with an outer upper 9 that extends above the sleeve 5, glue dabs 15 attaching the outer upper to different zones of the sleeve between its base 8 and its upper edge 6.

Furthermore, the outer upper 9 may have an inner lip 16 extending downwards covering the upper edge 6 of the sleeve 5 particularly to prevent friction between the upper edge and the user's leg, the lip possibly being fixed to the inside of the sleeve.

In the case in which the height of the sleeve 5 is approximately equal to the height of the outer upper 9, the upper edge 11 of the outer upper may be fixed to the upper edge 6 of the sleeve particularly by stitches 17, the edging part 14 possibly being fixed to the upper edges (FIG. 6*b*).

The footwear can be used as is, the user's foot being directly inserted into the holding housing 3 with the sleeve 5 being extended. As a variant, it can be planned to place an inner sock 18 into the boot 1 after extension of the sleeve 5, the sock defining a housing in which at least the user's foot can fit, and being designed to improve the impermeability and/or thermal insulation properties of the footwear.

The sock 18 can be made from a single part from a textile material, for example based on wool and/or a polyurethane foam material, that is designed to improve thermal insulation of the housing of the sock. The sock 18 may also include different layers with complementary insulating, absorbing and/or friction reduction properties. The sock 18 may thus include a hyper-absorbent layer in order to limit the effects of sweating and to manage transfer of moisture from the foot to the outside of the sock.

Advantageously, the boot 1 is fitted with a sock 18 that extends inside the intermediate part 2 and at least partly inside the sleeve 5 to guarantee that the foot is kept warm and dry. According to the embodiments shown, the sock 18 has dimensions adapted to extend over the entire internal part of the boot 1, particularly to prevent movements of the sock inside the boot when bearing on the ground, the sock having an outside geometry that is similar to the inside geometry of the boot.

In particular, the sock 18 has part of sole 19 that, when the sock is placed inside the holding housing 3, is located on the bottom sole of the intermediate part 2, the part of sole possibly forming an insole of the footwear. As a variant, an insole may be included inside the sock 18 on the part of sole 19 depending on the properties of the part of sole and/or the user's needs.

The sock 18 may be fixed inside the boot 1, for example by stitching with the upper edge 6, 11 of the sleeve 5 and/or the outer upper 9, or advantageously it may be inserted removably in the boot. By being removable, the sock 18 can thus be removed from the boot 1, notably so that the sock can be replaced, washed and/or dried independently of the boot.

The sock 18 may for example be replaced by another sock depending on the degree of warmth required inside the footwear. To make it easier to remove the sock 18 from inside the boot 1, it can be planned to fit the sock 18 with a pull string 20 that extends outwards from the back upper edge of the sock.

What is claimed is:

1. A method of making footwear including a boot fitted with an outer upper, said method comprising:

forming the boot comprising an intermediate part that delimits a housing for holding a user's foot, a top sleeve surmounting said intermediate part, and a peripheral lip extending from a junction zone between said intermediate part and said sleeve and surrounding a base of said sleeve;

said method including the following successive steps to fit the outer upper on said boot:

retracting the sleeve into the housing until said sleeve is located under at least a part of the lip;

attaching a lower part of the outer upper on said lip; and extending said sleeve above the intermediate part so that the sleeve extends inside said outer upper.

2. The method according to claim 1, wherein when retracting the sleeve, the sleeve is retracted at least until an upper edge of said sleeve is located under an upper edge of the lip.

3. The method according to claim 1, wherein when forming the boot, the intermediate part and the sleeve are made in a single-piece molded from a thermoplastic material.

4. The method according to claim 1, wherein when forming the boot, the sleeve of the boot has a thickness adapted to facilitate retraction of said sleeve into the housing.

5. The method according to claim 1, wherein when attaching the lower part, the lower part of the outer upper is permanently fixed onto the lip by stitching.

6. The method according to claim 1, wherein when forming the boot, the boot is formed with a peripheral groove that extends between the lip and the base of the sleeve, and the lower part of the outer upper being placed in said groove before the lower part of the outer upper is attached to said lip.

7. The method according to claim 1, further comprising attaching the outer upper onto the sleeve after extension of said sleeve inside said outer upper.

8. The method according to claim 1, further comprising placing a sock into the boot after extending the sleeve.

* * * * *